US006412635B1

(12) United States Patent
Lu

(10) Patent No.: US 6,412,635 B1
(45) Date of Patent: Jul. 2, 2002

(54) NON-ORTHOGONAL PACKING METHOD AND APPARATUS

(75) Inventor: Torence Lu, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/608,415

(22) Filed: Jun. 30, 2000

(51) Int. Cl.[7] ..... B65D 81/113

(52) U.S. Cl. ..... 206/523; 206/586; 206/591; 206/592; 206/723

(58) Field of Search ..... 206/523, 583, 206/584, 586, 591, 592, 594, 485, 590, 723

(56) References Cited

U.S. PATENT DOCUMENTS

| | | | | | |
|---|---|---|---|---|---|
| 1,250,770 | A | * | 12/1917 | Beach | 206/485 |
| 1,392,791 | A | * | 10/1921 | Pettee | 206/591 |
| 1,896,326 | A | * | 2/1933 | Northway-Ley | 206/485 |
| 1,921,110 | A | | 8/1933 | Wheary | 190/41 |
| 2,611,529 | A | | 9/1952 | Currivan | 229/38 |
| 2,714,981 | A | | 8/1955 | Leavens | 229/38 |
| 2,790,588 | A | | 4/1957 | Deeren | 229/14 |
| 3,161,339 | A | | 12/1964 | Weller | 229/14 |
| 3,232,513 | A | | 2/1966 | Maio | 229/14 |
| 3,572,574 | A | | 3/1971 | Mears | 229/14 |
| 3,938,661 | A | | 2/1976 | Carmody | 206/523 |
| 4,116,334 | A | * | 9/1978 | Herzog | 206/586 |
| 4,320,829 | A | * | 3/1982 | DiMarzio et al. | 206/314 |
| 4,793,123 | A | | 12/1988 | Pharo | 53/449 |
| 5,064,062 | A | | 11/1991 | Miller | 206/316.2 |
| 5,232,095 | A | * | 8/1993 | Childers et al. | 206/583 |
| 5,786,580 | A | * | 7/1998 | Yeo | 026/583 |

* cited by examiner

*Primary Examiner*—David T. Fidei
(74) *Attorney, Agent, or Firm*—Skjerven Morrill LLP; Samuel G. Campbell, III

(57) ABSTRACT

An item to be packaged which has at least a first substantially planar surface is positioned within the carton, also having at least a first substantially planar exterior carton surface such that the plane of the item to be packaged is non-orthogonal to and non-parallel with the plane of the carton exterior. In one aspect, a substantially parallelepiped-shaped item is rotated about one, two or three orthogonal axes for placing in a carton which may itself have a substantially parallelepiped exterior shape.

13 Claims, 2 Drawing Sheets

NON-ORTHOGONAL PACKING METHOD AND APPARATUS

The present invention relates to packaging an item such that the plane of at least one surface of the item to be packaged is non-parallel to the planes of the outer surfaces of a carton or similar container and in particular to such packaging of an item having a rectangular parallelepiped shape.

BACKGROUND INFORMATION

A number of approaches have been previously proposed or attempted for packaging items to reduce or eliminate damage from dropping or other handling of the package. In some approaches, the item to be packaged is enclosed in an inner container which, in turn, is positioned within an outer container. This is often done in a manner to assure that the item being packaged is spaced from the walls of the outer container. Although this approach has been useful for a number of purposes, it is believed that there is an opportunity for additional packaging improvement, especially when the item to be packaged has at least one planar surface and/or, when the item to be packaged has a parallelepiped shape (having six planar surfaces). Without wishing to be bound by any theory, it is believed that previous approaches have tended to orient surfaces of an object parallel to outer surfaces of a carton, e.g. in order to achieve efficiency of space (i.e., packing as many packaged items as possible within a trailer, railroad car, warehouse, storeroom, retail shelf or other space, and the like). For such items, there is, in general, a particular risk of damage. Without wishing to be bound by any theory, it is believed that damage occurs particularly when the outer carton is dropped (or otherwise subjected to a shock) on a carton face which is parallel to (or, in some cases, perpendicular to) the plane of a surface of the item which is packaged. Previous approaches involving an inner carton were typically less concerned with the direction of force vectors than with providing spacing from the outer carton walls. Accordingly, little or no attention was previously given to the risks of arising from parallel or orthogonal relationships between outer surfaces of the carton and planes of the item to be packaged. Indeed, many previous approaches involving an inner package were directed to protecting electronic tubes and other items having a substantially circular profile (and which, thus, did not have a parallelepiped and/or planar-surface shape).

Another approach has involved rolling an item up in an inflated or inflatable bladder device and placing assembly within a carton. As with the inner-carton approach, this approach is principally directed to maintaining spacing between the item to be packaged and the outer carton and, in general, items to be packaged, using this approach, would be as likely to be in a parallel or orthogonal relationship to the carton walls as any other orientation, since there was generally no device or procedure to assure any particular orientation within the outer carton.

Accordingly, it would be useful to provide a system, method and apparatus which can assist in reducing or eliminating certain types of damage arising from dropping or other shocks on a parallelepiped-shaped item or other item having one or more planar surfaces.

SUMMARY OF THE INVENTION

The present invention includes a recognition of the existence, nature and/or source of problems in previous approaches, including as described herein. According to one aspect of the present invention, an item to be packaged which has at least one planar surface, is positioned within an outer carton, itself having one or more planar surfaces, such that at least one planar surface of the item to be packaged is non-parallel to any of the planar surfaces of the outer carton. In one aspect, the item to be packaged is a rectangular parallelepiped defining width, height and depth axes, the outer parallelepiped carton also defining carton width, height and depth axes, the item to be packaged being positioned in the carton with at least one, and, and in some embodiments, two or three, axes tipped or angled with respect to axes of the carton. Preferably foam, cardboard or other inserts provide and/or maintain such non-orthogonal orientation of the item to be packaged. In some embodiments, the additional resistance to damage provided by such packaging can allow less robust (and less expensive) versions of items to be developed, such as by providing for chassis, panels or other components made of thinner and/or less expensive materials.

In one aspect, an item to be packaged which has at least a first substantially planar surface is positioned within the carton, also having at least a first substantially planar exterior carton surface such that the plane of the item to be packaged is non-orthogonal to and non-parallel with the plane of the carton exterior. In one aspect, a substantially parallelepiped-shaped item is rotated about one, two or three orthogonal axes for placing in a carton which may itself have a substantially parallelepiped exterior shape.

DETAILED DESCRIPTION OF THE PREFERRED EMBODIMENT

As noted above, it is believed likely that approaches involving placing items with faces parallel to carton faces reflect a desire to provide high efficiency in space utilization and other economies. Without wishing to be bound by any theory, it is believed that there has been a tendency to persist in such packaging approaches, even as economics of the situation may have shifted. For example, as the ratio of the value of the item being shipped, to the cost of shipping, storing and the like increases, the present invention involves a recognition that, it becomes more economically feasible to accept certain packaging or space inefficiencies (and higher shipping or storage cost) if this makes it possible to reduce the occurrence of damage to relatively high-value items.

Although the present invention can be used in connection with many types of items, it is believed to be especially useful in connection with high value electronic items (which are also items which can be easily damaged by dropping or similar handling) including, for example, network electronic devices such as routers, switches, hubs, gateways and the like.

Figure 1:
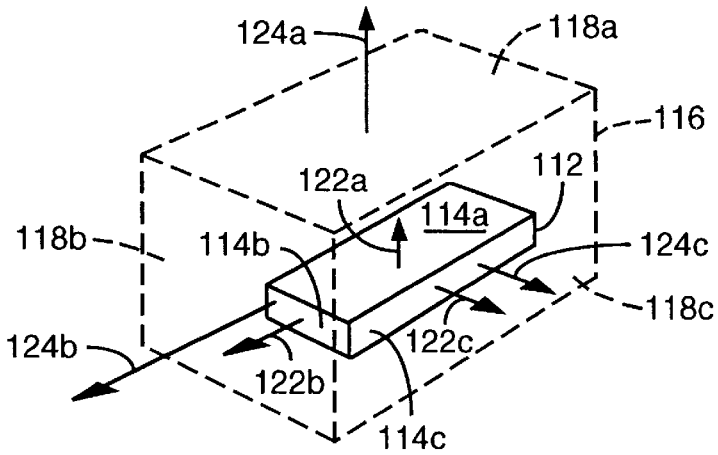
FIG. 1 (PRIOR ART)
FIG. 1 is a perspective view of typical orthogonal packaging of a parallelepiped-shaped item, according to previous approaches with a carton shown in phantom.
Figure 2A:
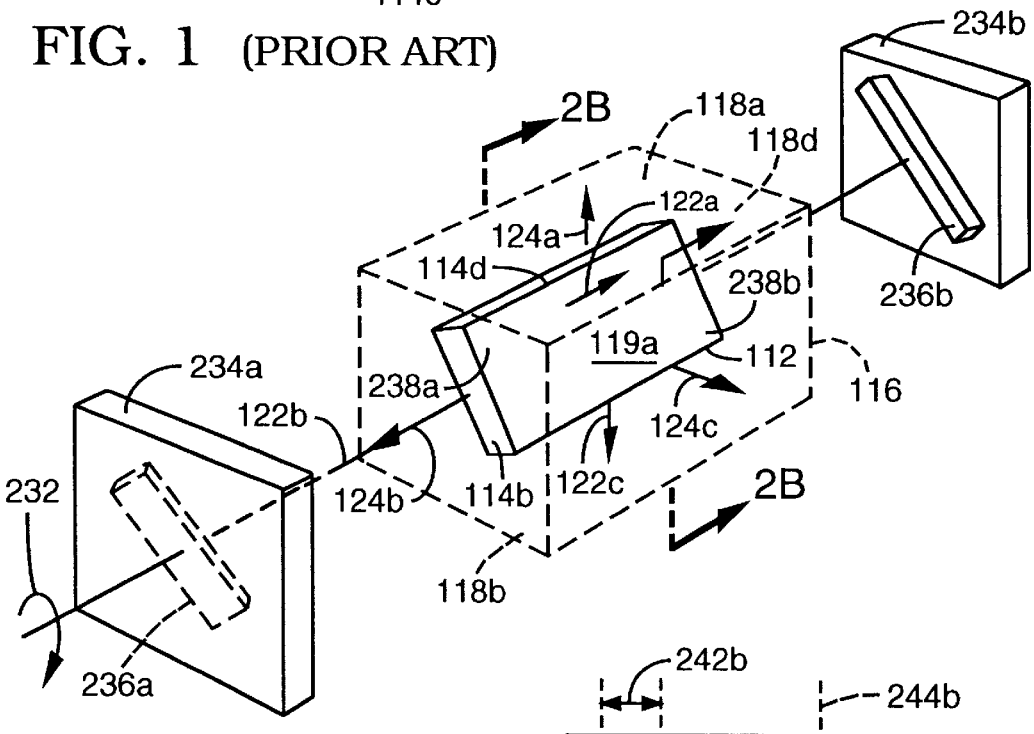
FIG. 2A is a perspective view of, partially exploded, of packaging of an item with rotation about a first axis according to an embodiment of the present invention, with a carton shown in phantom.
Figure 2B:
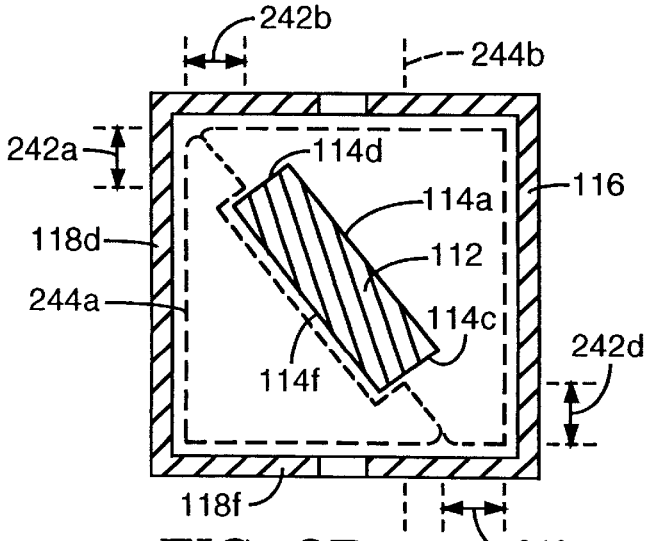
FIG. 2B is a cross-sectional view taken along plane 2B–2B of FIG. 2A.

As depicted in FIG. 1, an item to be packaged 112 has at least a first planar surface 114 and may have additional planar surfaces 114*b*, 114*c*, 114*d* (FIG. 2A), 114*e* (FIG. 5), 114*f* (FIG. 2B). Although the present invention can be used in connection with items having a variety of shapes, defining at least one plane, in the depicted embodiment, the item 112 is a parallelepiped, i.e., a shape having three mutually orthogonal pairs of spaced-apart, rectangular surfaces. Although it is common for at least some electronic devices to have surfaces which are substantially planar, as will be understood by those of skill in the art, such planar surfaces may have local recesses, detents, projections or attachments (such as controls, dials, handles, plugs, connectors, displays and the like.) Typically, the substantially planar surfaces will be defined by outer surfaces of a chassis and/or panel, one or more which will typically be accessible or visible to users in normal use.

In the configuration of FIG. 1, the item to be packaged 112 is positioned within a carton 116. As will be understood by those of skill in the art, it is common to provide cartons 116 of materials such as corrugated or other cardboard or press board, although numerous other materials could, at least theoretically, be used in connection with the present invention including wood, Masonite, plastic and similar materials.

Although the present invention can be used in connection with a variety of shapes of cartons, in the depicted embodiment, the outer carton 116 has a parallelepiped-shape and defines substantially planar surfaces including, e.g., 118*a,b,c*. Although not visible in FIG. 1, the carton 116 has a surface 118*d* parallel to surface 118*c*, as a bottom surface 118*f* parallel to the top surface 118*a* (FIG. 2B) and has a surface 118*e* parallel to surface 118*b*.

As shown in FIG. 1, the item being packaged 112 defines three orthogonal axes, a height or vertical axis 122*a* (orthogonal to the upper surface 114*a*) a width axis 122*b* (orthogonal to the side surface 114*b* ) and a depth axis 122*c* (orthogonal to the front surface 114*c* ). Similarly, the carton 116 has a carton height axis 124*a* (perpendicular to top surface 118*a* ), carton width axis 124*b* (perpendicular to side surface 118*b* ) and carton depth axis 124*c* (perpendicular to front surface 118*c*).

As noted above, in previous approaches, it is typical to position one or more surfaces of the item being packaged 112 parallel to one or more surfaces of the carton 116. In configurations where both the item to be packaged 112 and the carton 116 had parallelepiped-shapes, it was typical to position the item 112 within the carton 116 such that the three axes 122*abc* defined by the parallelepiped item 112 were parallel with the three axes 124*abc* of the carton 116, as depicted in FIG. 1. As will be understood by those of skill in the art, this also means that the six planes defined by the surfaces of the parallelepiped item 112 are parallel to the six planes of the outer surface of the carton 116, such as surface 114*a* being parallel to surface 118*a*, surface 114*b* being parallel to surface 118*b*, surface 114*c* being parallel to surface 118*c* and the like. As will be understood by those of skill in the art, this configuration also means that each surface of the package 116 is orthogonal to four surfaces of the item being packaged 112. For example, the upper surface 118*a* is orthogonal to the planes defined by the side surfaces 114*b*, 114*c*, 114*d* , 114*e* (sides 114*d* and e not visible in the view of FIG. 1.)

As noted above, it is believed that attempts to achieve high space efficiency are least partially responsible for the described parallel and orthogonal relationships between surfaces of the item being packaged and outer surfaces of the outer container.

As seen in FIG. 2A, according to one embodiment of the present invention, the item being packaged 112 is positioned such that the upper surface 118*a* of the outer carton 116 is non-orthogonal to surfaces 114*d* and 114*c* (see FIG. 2B) and is non-parallel to surface 114*a*. Although surfaces 114*b*, 114*e* of the item to be packaged 112 are still parallel to the corresponding surfaces 118*b*, 118*e* of the carton 116. The prior configuration depicted in FIG. 1 is modified, to yield the configuration of FIG. 2A by rotating 232 the item to be packaged 112 an amount which is not a multiple of 90°, about the width axis 122*b*. Although, in the embodiment of FIG. 2A, the width axis 122*b* remains parallel to the carton width axis 124*b*, the vertical axis 122*a* and depth axis 122*c* of the item to be packaged 112 are no longer parallel to the height axis 124*a* and depth axis 124*c* of the carton 116.

Preferably, to assist in positioning and/or maintaining the item to be packaged 112 in this orientation, inserts 234*a,b* can be placed within the carton 116 with the inserts having openings or recesses 236*a,b* for receiving opposed end portions 238*a,b* of the item to be packaged 112. Preferably, the inserts 238*a,b* are configured to also maintain the item to be packaged 112 spaced 242*a,b,c,d* (FIG. 2B) from the carton walls 116. A number of materials can be used for inserts 234*a,b* including Styrofoam, foam rubber or other foam items, cardboard, inflated or inflatable cushions and the like, as will be understood by those of skill in the art. Also as will be understood by those of skill in the art, other shapes or configurations of inserts or spacers can be used such as wedge-shaped items 244*a,b* of foam, cardboard and the like, in place of or in addition to end inserts 234*a,b*. If desired, spaces in the carton 116 not occupied by the item to be packaged 112 can be used for containing other items (such as cables, accessories, peripherals, batteries, mounting hardware, instruction or other pamphlets and the like).

Figure 3:
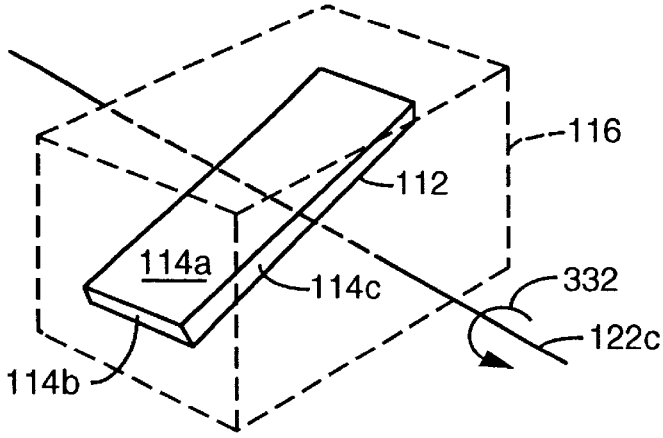
FIG. 3 is a perspective view of packaging similar to the embodiment shown in FIG. 2A, but with rotation around second axis, according to an embodiment of the present invention.
Figure 4:
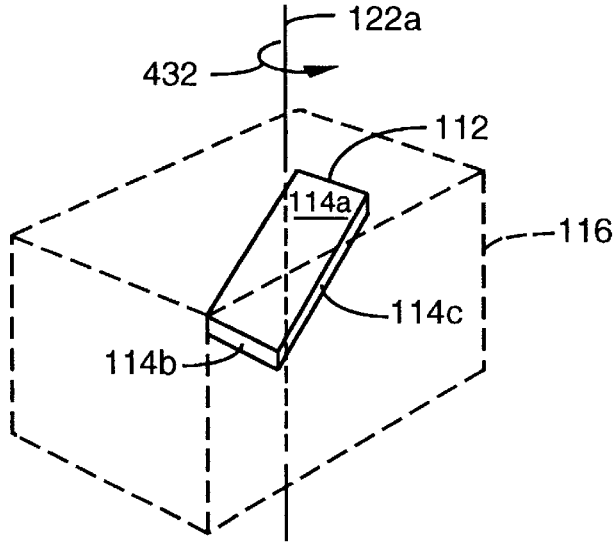
FIG. 4 is a perspective view similar to the embodiment depicted in FIG. 2A, but with rotation about a third axis according to an embodiment of the present invention.
Figure 5:
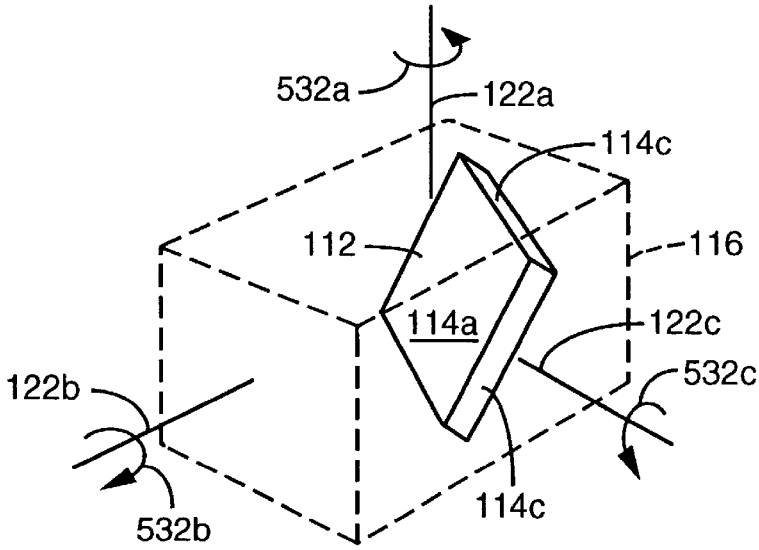
FIG. 5 is a perspective view, similar to the embodiment depicted in FIG. 2A, but showing rotation about three-axes, according to an embodiment of the present invention.

FIGS. 3, 4 and 5 depict embodiments in which the item to be packaged 112 is non-orthogonally positioned by rotating 332, 432, 532*a,b,c* about axes 122*c*, 122*a* other than (or in addition to) the rotation axis 122*b* of FIG. 2A. In FIG. 3, rotation 332 is about the depth axis 122*c*. In the embodiment of FIG. 4, rotation 432 is about the height axis 122*a*. In the embodiment of FIG. 5, rotation 532*a,b,c* is about all three axes 122*a,b,c*.

Table I summarizes various planes and axes of the carton 116 to which the surfaces and axes of the item to be packaged 112 are parallel, respectively, for each of FIGS. 1, 2A, 3, 4 and 5. Table II presents similar information for the planes and axes of the carton 116 to which the surfaces and axes of item 112 are perpendicular.

TABLE I

For FIGS. 1, 2A, 3, 4 and 5, planes and axes of carton to which the surfaces and axes of item 112 are parallel.

| | FIG. 1 | FIG. 2A | FIG. 3 | FIG. 4 | FIG. 5 |
|---|---|---|---|---|---|
| 114a | 118a, f | None | None | 118a, f | None |
| 114b | 188b, e | 188b, e | None | None | None |

TABLE I-continued

For FIGS. 1, 2A, 3, 4 and 5, planes and axes of carton to which the surfaces and axes of item 112 are parallel.

| | FIG. 1 | FIG. 2A | FIG. 3 | FIG. 4 | FIG. 5 |
|---|---|---|---|---|---|
| 114c | 118c, d | None | 118c, d | None | None |
| 114d | 118c, d | None | 118c, d | None | None |
| 114e | 188b, e | 188b, e | None | None | None |
| 114f | 118a, f | None | None | 118a, f | None |
| 122a | 118a | None | None | 124a | None |
| 122b | 118b | 124b | None | None | None |
| 122c | 118c | None | 124c | None | None |

For FIGS. 1, 2A, 3, 4 and 5, planes and axes of carton to which the surfaces and axes of item 112 are perpendicular.

TABLE II

For FIGS. 1, 2A, 3, 4 and 5, planes and axes of carton to which the surfaces and axes of item 112 are perpendicular.

| | FIG. 1 | FIG. 2A | FIG. 3 | FIG. 4 | FIG. 5 |
|---|---|---|---|---|---|
| 114a | 118b, e, c, d | None | None | 118b, e, c, d | None |
| 114b | 118a, f, c, d | 118a, f, c, d | None | None | None |
| 114c | 118a, f, b, e | None | 118a, f, b, e | None | None |
| 114d | 118a, f, b, e | 118a, f, b, e | 118a, f, b, e | None | None |
| 114e | 118a, f, c, d | 118a, f, c, d | None | None | None |
| 114f | 118b, e, c, d | None | None | 118b, e, c, d | None |
| 122a | 124b, c | None | None | 124b, c | None |
| 122b | 124a, c | 124a, c | None | None | None |
| 122c | 124a, b | None | 124a, b | None | None |

In general, the packaging process can include pressing a pre-shaped insert onto one or both ends of the item to be packaged and inserting the assembly into the carton and taping or otherwise sealing the carton. In other embodiments, however, at least some of the inserts or spacers may be placed into the carton after the item to be packaged has been inserted in the carton. In some embodiments, volume metrically expanding foam or other expanding material may be injected into the carton.

In light of the above description, a number of advantages of the present invention can be seen. The present invention can reduce or avoid the incidence of damage to packaged items having at least one planar surface, and especially for parallelepiped-shaped items, e.g., when the package is dropped or otherwise exposed to a shock, especially being dropped on one of its faces (and/or providing a shock with a substantial component perpendicular to one of its faces). Without wishing to be bound by any theory, it is believed that embodiments of the present invention disperse such (otherwise uni-axial) input shock along several axes of the packaged device. By providing axes of the packaged device, one or more of which are skewed with respect to axes or faces of the carton or other package, embodiments of the present invention avoid aligning major axes of the product with major axes of the package. It is believed that in general, in this configuration, when a package is dropped on one of its faces, the item packaged travels (or receives shock along) a non-orthogonal (with respect to surfaces or axes of the item packaged) direction, distributing the input shock levels along two or more axes, preferably along all three axes or dimensions, reducing the unit's highest observed shock levels. Although the invention is believed particularly useful in avoiding damage resulting from shock perpendicular to a package face, it is believed that, in general, if a package is dropped on one of its corners, (even if this means one or more surfaces of the unit is oriented substantially parallel or orthogonal to the shock vector) the comer itself typically will be crushed (absorbing some of the shock input), and typically the carton will rotate or tumble about the comer, impacting or coming to rest on a face and again dispersing the input shock along several axes. In some situations, non-orthogonal product packaging including as described herein can allow the product enclosure or chassis, or other components, to be designed less robustly (since the maximum shocks it will normally need to withstand are less) and/or lighter (since the plastic or sheet metal enclosure could use thinner walls) and therefore, less expensive to produce (e.g., as a result of using thinner or otherwise less material and/or less expensive material) and/or ship. Additionally, embodiments of the present invention can be used to increase lifetime and/or reliability of the product (which, in some cases, in the absence of features which reduce damage, may exhibit malfunction caused or exacerbated by dropping or other handling, some period of time after being put into use).

A number of variations and modifications of the invention can be used. It is possible to use some aspects of the invention without using others. For example, it is possible to tilt or skew the orientation of the item being packaged (with respect to the surfaces of the carton) along one axis or surface without skew or tilt with respect to another axis or surface. It is possible (although not necessarily optimal) to provide for non-orthogonal packaging without providing for substantial spacing of the item to be packaged inwardly from the walls of the outer carton. Although the depicted embodiments that show packaging of an item in the parallelepiped-shape, it is also possible to use embodiments or aspects of the present invention in connection with items having other shapes with at least one surface of the item defining at least a first plane. It is believed, however, that the invention is especially useful in connection with parallelepiped-shaped items. Although an outer carton having a substantially parallelepiped-shape was depicted, the present invention can be used in connection with other outer carton or container shapes having at least one planar surface. Although embodiments were depicted in which the unit is held in a non-orthogonal position by inserts, it is also possible to hold the unit in a desired position by formed features from the walls of a box and/or by features on the unit (the item to be packaged) itself. Although embodiments have depicted cartons having a substantially parallelepiped shape, other shapes of cartons can also be used including cartons having substantially hexagonal or triangular profiles, and other shapes adapted to tiling and/or closest-packing (gapless) stacking.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An apparatus for packaging comprising:

a carton having a carton outer surface including at least a first exterior surface defining a first carton plane; and a device positioned at least partially within said carton outer surface supporting an electronic device having at least a first surface defining a first plane, stationary relative to said carton, in an attitude such that at least said first plane is non-orthogonal to, and non-parallel with, said first carton plane, said electronic device including a parallelepiped-shape, said device including first and second wedge-shaped inserts each defining a support portion supporting said parallelepiped-shaped electronic device therebetween.

2. An apparatus, as claimed in claim 1, wherein said carton exterior surface comprises a parallelepiped-shape.

3. An apparatus, as claimed in claim 1, wherein said electronic device is selected from the group consisting of a network router, a network hub, a network switch, and a network gateway.

4. An apparatus for packaging, comprising:

a carton defining at least six substantially planar exterior faces;

a parallelepiped-shaped electronic device having at least six substantially planar surfaces; and means for supporting said parallelepiped-shaped electronic device stationary within said carton such that said at least six substantially planar surfaces are non-orthogonal to and non-parallel wit each of said at least six planar exterior faces of said carton.

5. A apparatus, as claimed in claim 4, wherein said means for positioning comprises an insert.

6. An apparatus, as claimed in claim 4, wherein said means for positioning comprises a portion of said carton.

7. An apparatus, as claimed in claim 4, wherein said means for positioning comprises a portion of said electronic device.

8. An apparatus, as claimed in claim 4, wherein said means for positioning includes material selected from the group consisting of Styrofoam, foam rubber, and cardboard.

9. An apparatus, as claimed in claim 4, wherein said carton exterior surface comprises a parallelepiped-shape.

10. An apparatus, as claimed in claim 4, wherein said electronic device is selected from the group consisting of a network router, a network hub, a network switch, and a network gateway.

11. An apparatus, as claimed in claim 1, wherein said device comprises an insert.

12. An apparatus, as claimed in claim 1, wherein said device comprises a portion of said carton.

13. An apparatus, as claimed in claim 1, wherein said device includes material selected from the group consisting of Styrofoam, foam rubber, and cardboard.

* * * * *

UNITED STATES PATENT AND TRADEMARK OFFICE

CERTIFICATE OF CORRECTION

PATENT NO. : 6,412,635 B1
DATED : July 2, 2002
INVENTOR(S) : Torence Lu

It is certified that error appears in the above-identified patent and that said Letters Patent is hereby corrected as shown below:

Column 8,
Line 9, please replace “wit” with -- with --.

Signed and Sealed this

Twenty-ninth Day of June, 2004

JON W. DUDAS
*Acting Director of the United States Patent and Trademark Office*